United States Patent [19]

Hoeberling

[11] Patent Number: 4,924,485

[45] Date of Patent: May 8, 1990

[54] PORTABLE RADIOGRAPHY SYSTEM USING A RELATIVISTIC ELECTRON BEAM

[76] Inventor: Robert F. Hoeberling, 502 Hamlin Ct., Los Alamos, N. Mex. 87544

[21] Appl. No.: 99,850

[22] Filed: Sep. 22, 1987

[51] Int. Cl.[5] ..... H05G 1/24

[52] U.S. Cl. ..... 378/102; 378/101; 378/106; 315/338

[58] Field of Search ..... 378/101, 102, 103, 106, 378/138, 136; 250/493.1, 427, 391 R; 315/94, 111.41, 338, 344; 376/108, 111-114

[56] References Cited

U.S. PATENT DOCUMENTS

| | | | |
|---|---|---|---|
| 3,571,594 | 3/1971 | Nobel | 376/114 |
| 3,643,094 | 2/1972 | Courtois | 250/87 |
| 3,681,604 | 8/1972 | Criswell et al. | 250/93 |
| 3,946,236 | 3/1976 | Roberts et al. | 250/402 |
| 4,121,123 | 10/1978 | Crolius | 310/10 |
| 4,422,013 | 12/1983 | Turchi et al. | 315/111.61 |

OTHER PUBLICATIONS

A. I. Pavlovskii et al., "Transformer Energy Output Magnetic Cumulation Generators," Proceedings of the Second International Conference on Megagauss Magnetic Field Generation and Related Topics, Washington, D.C., May 30-Jun. 1, 1979 (Plenum Press, New York 1980).

*Primary Examiner*—Carolyn E. Fields
*Assistant Examiner*—David P. Porta

[57] ABSTRACT

A portable radiographic generator is provided with an explosive magnetic flux compression generator producing the high voltage necessary to generate a relativistic electron beam. The relativistic electron beam is provided with target materials which generates the desired radiographic pulse. The magnetic flux compression generator may require at least two conventional explosively driven generators in series to obtain a desired output voltage of at least 1 MV. The cathode and anode configuration of the diode are selected to provide a switching action wherein a high impedance load is presented to the magnetic flux compression generator when the high voltage is being generated, and thereafter switching to a low impedance load to generate the relativistic electron beam. Magnetic flux compression generators can be explosively driven and provided in a relatively compact, portable form for use with the relativistic x-ray equipment.

15 Claims, 7 Drawing Sheets

PORTABLE RADIOGRAPHY SYSTEM USING A RELATIVISTIC ELECTRON BEAM

This invention is the result of a contract with the Department of Energy (Contract No. W-7405-ENG-36).

BACKGROUND OF THE INVENTION

The invention relates to neutron and x-ray radiography apparatus and more particularly to apparatus for use in nondestructive radiography for producing neutrons and x-rays with a relativistic electron beam pulse.

Welds on structures such as ship hulls, bridges, metal building frames, and the like, for safety should be examined for integrity. An apparatus in accordance with the present invention can be used to nondestructively radiograph such structures to verify their welds and other desired features. The invention may be practiced with portable devices making inspection far easier than with existing devices which are large, cumbersome and expensive. Existing devices also require an accessible external power source, whereas an apparatus in accordance with the invention contains its own power supply. It is therefore easy to use the invention at remote locations.

Conventional radiography devices provide penetrating radiation by bombarding an anode target with high energy electrons emitted from a cathode. Relatively low-voltage portable x-ray devices are shown in U.S. Pat. Nos. 3,643,094, issued Feb. 14, 1972, and 3,783,288, issued Jan. 1, 1974, with operating voltages at about 100 kV and 350 kV, respectively. The production of higher voltages, however, conventionally requires equipment which is not portable.

Magnetic flux compression generators (MFCGs) can be designed for portability, however, and generate relatively high voltages. A series of explosively driven magnetic cumulation generators used to produce a high voltage is disclosed by A. I. Pavlovski et al. in "Transformer Energy Output Magnetic Cumulative Generators," Proceedings of the Second International Conference on Megagauss Magnetic Field Generation and Related Topics (Plenum Press, New York, 1980). A capacitor bank or permanent magnet is used to generate a first magnetic field. That first magnetic field and subsequent fields are rapidly collapsed using explosives to produce a high voltage output which is coupled to a load with a transformer. Pavlovski et al. teach cascading MFCGs for energy amplification. No particular load application is taught, and voltage levels to only about 400 kV are taught.

A relatively high power diode is a diode structure generating a relativistic electron beam. Such a device typically requires an operating voltage about 1 MV for generating the relativistic beam. However, conventional relativistic beam diodes tend to generate a plasma layer adjacent the cathode due to work function heating as electrons are emitted from the cathode. The low resistance associated with the plasma would conventionally prevent a flux compression generator from reaching the high voltage levels for relativistic beam operation.

These and other problems of the prior art are addressed by the present invention and a portable radiography apparatus is provided with flux compression generators supplying high voltage to a relativistic beam diode.

Accordingly, an object of the present invention is to load a compression flux generator with a relativistic beam diode.

Another object of the present invention is to preclude generation of the diode electron beam until a maximum voltage is output from the compression flux generator.

One other object of the present invention is to provide portable nondestructive neutron and the x-ray radiography.

SUMMARY OF THE INVENTION

To achieve the foregoing and other objects, and in accordance with the purposes of the present invention, as embodied and broadly described herein, the apparatus of this invention may comprise a portable radiographic generator. A magnet is provided for producing a field comprising magnetic flux with a magnetic flux compression means to produce a high voltage pulse effective for generating a relativistic electron beam. A diode having a cathode and an anode is responsive to the voltage pulse, where the cathode and the anode are configured for generating a relativistic electron beam pulse after the voltage obtains a selected value, and thereafter switching to a low impedance value for generating the relativistic electron beam.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Figure 1:
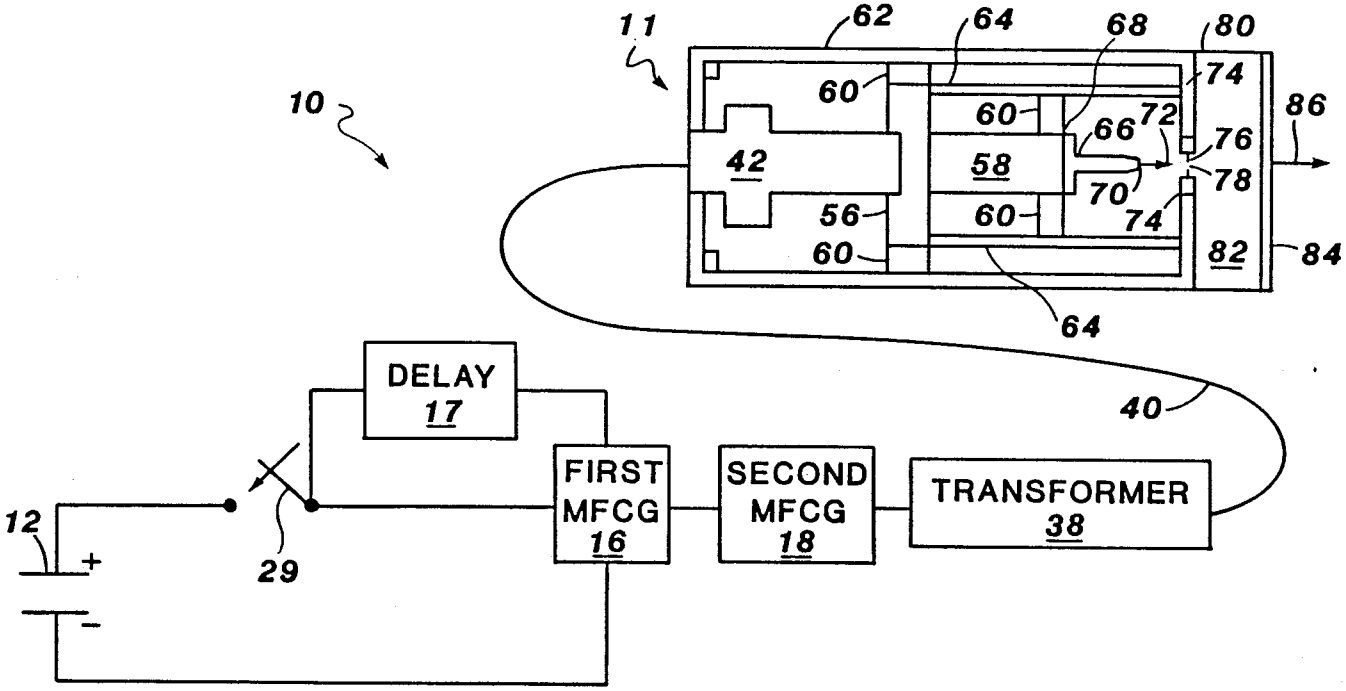
FIG. 1 schematically shows a neutron pulse producing embodiment of the invention utilizing capacitive initial magnetic flux field generation.

Reference is now made to FIG. 1 which schematically shows a neutron pulse producing embodiment of the invention for use in nondestructive neutron radiography. As seen therein, neutron generating apparatus 10 comprises capacitor bank 12, first MFCG 16, second MFCG 18, transformer 38, and radiographic apparatus 11.

Figure 2:
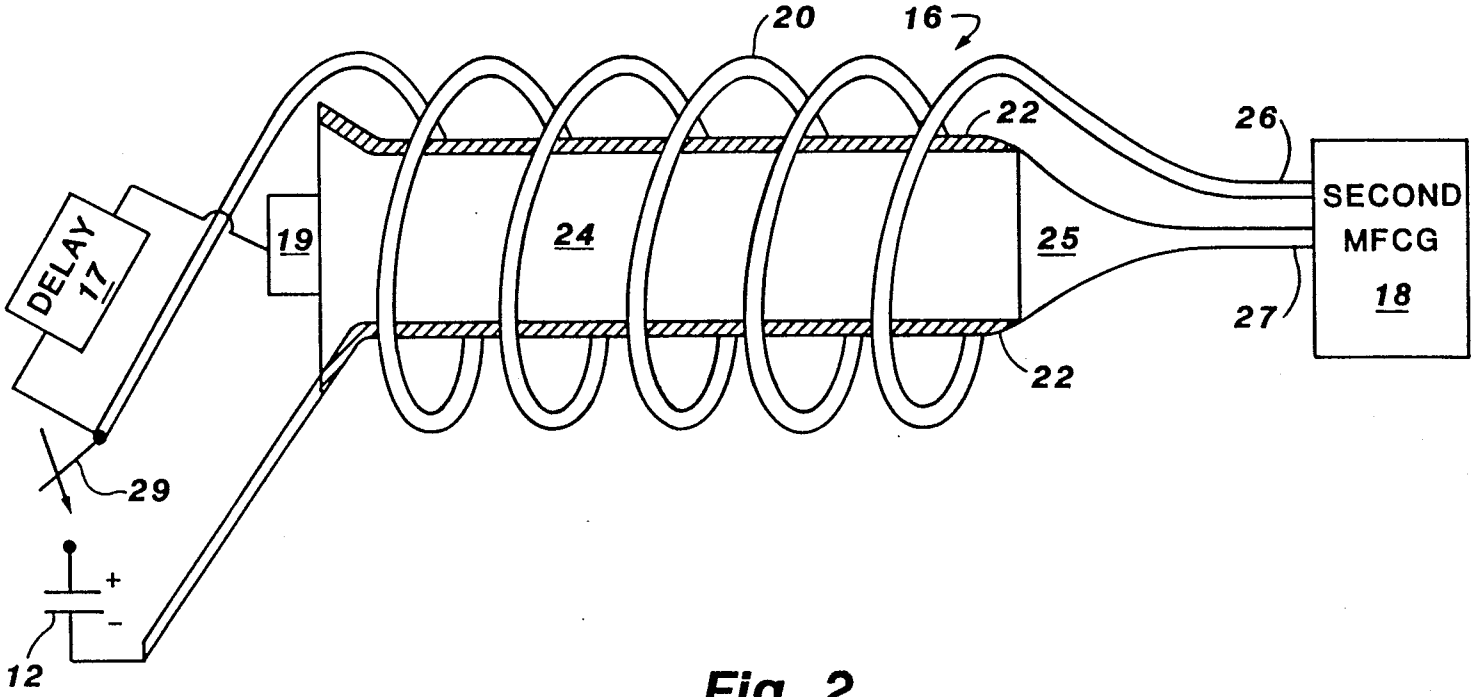
FIG. 2 schematically illustrates an exemplary first MFCG in accordance with the invention.
Figures 3, 4:
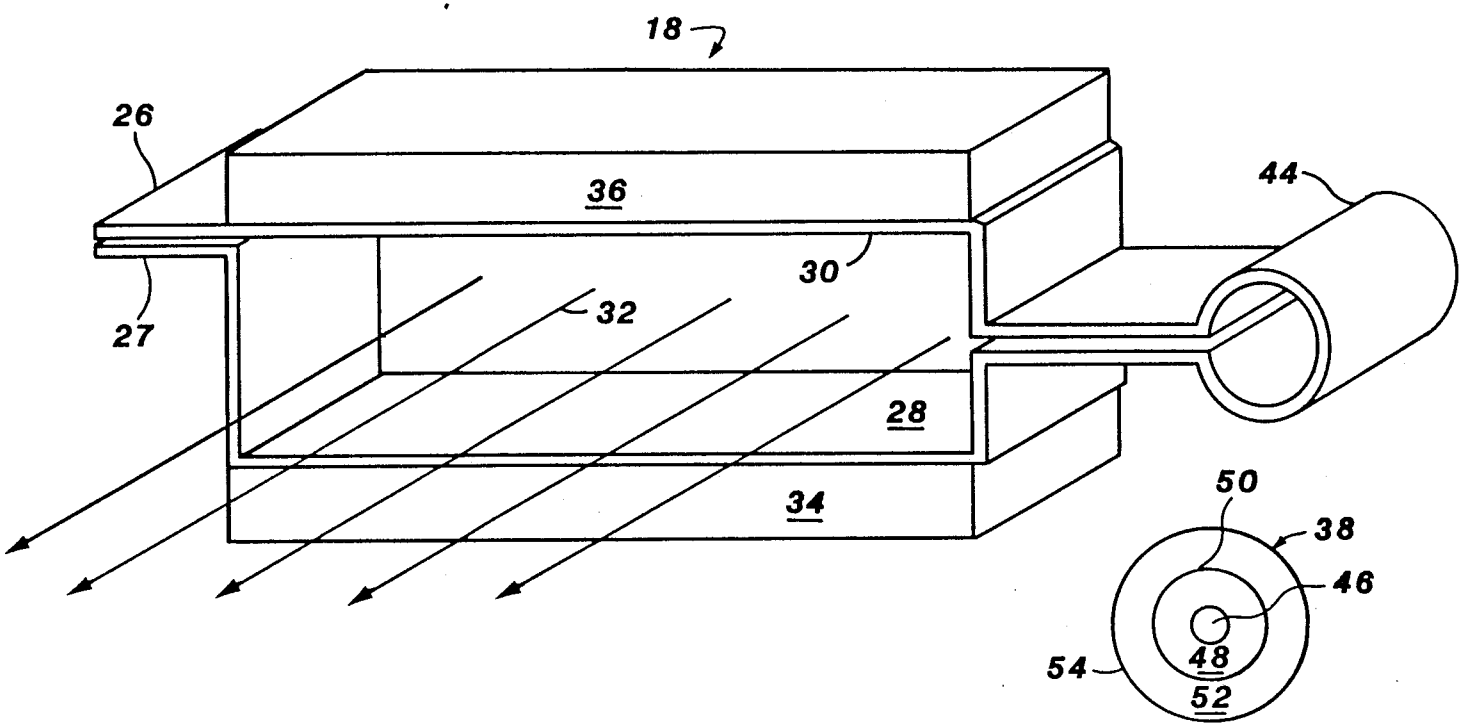
FIG. 3 schematically illustrates an exemplary second MFCG in accordance with the invention.
FIG. 4 is a cutaway end view of a transformer used in an exemplary embodiment of the invention.

FIGS. 2, 3 and 4 show MFCGs 16 and 18 and transformer 38, respectively, in more detail. As seen in FIG. 2, MFCG 16 comprises an inner cylindrical conductor 22 surrounded by an outer helical conductor 20 connected to switch 29 and second MFCG 18 through its first plate 26. Inner conductor 22 connects to capacitor bank 12 and through a nose cone 25 to a second plate 27 of MFCG 18. Elements 20, 22 and 25 as well as electrical current transmission structure thereto comprises copper in the preferred embodiment. Cylindrical conductor 22 is flared at its input end and surrounds an explosive 24 which is detonated during operation by firing a detonator 19 connected to switch 29 through delay circuitry 17.

Thus, when detonator 19 is fired, explosive 24 burns rapidly from the flared end of cylindrical conductor 22 toward nose cone 25 to drive conductor 22 out toward helical conductor 20. In operation, when switch 29 is thrown, a magnetic flux field is established between conductors 20 and 22 from an electrical pulse from capacitor bank 12. Conventional delay circuitry 17 fires detonator 19 at the appropriate time after switch 29 is thrown, approximately 50 μs later, which initiates explosive 24 to drive cylindrical conductor 22 outwardly toward helical conductor 20. The magnetic flux field therebetween is compressed to generate a first electrical output pulse of about 50 kV into second MFCG 18 through its plates 26 and 27. In the preferred embodiment, first explosive 24 may comprise a 165 g tube of Cyclotol ®, manufactured by the duPont company.

Referring now to FIG. 3, second MFCG 18 comprises first and second spaced parallel driver plates 30 and 28 connected to plates 26 and 27. Driver plates 28 and 30 produce a magnetic field indicated by arrows 32. First and second explosive pads 36 and 34 are disposed on first and second driver plates 30 and 28 and, in the embodiment illustrated, each pad contains about 6 kg of Cyclotol ®. Second MFCG 18 additionally comprises a cylindrical output element 44 for transmitting its electrical output pulse into transformer 38 (FIG. 4).

In operation, MFCG 16 (FIG. 2) is detonated to produce a first current pulse which, when transmitted to MFCG 18, creates a magnetic field represented by arrows 32 between driver plates 28 and 30. The output pulse from first MFCG 16 through plates 26 and 27 initiates explosive pads 36 and 34 thereby causing driver plates 30 and 28 to move toward one another to compress the flux in magnetic field 32. This produces an electric pulse output on the order of about 50 kV from the cylindrical output element 44 of MFCG 18 into transformer 38 (FIG. 4).

FIG. 4 is a cutaway end view of transformer 38 which in the preferred embodiment comprises a coaxial cable containing a foil wound air core secondary 46 made of copper film and insulating film rolled in alternating layers. Air core secondary 46 used in the preferred embodiment can be fabricated by Pulsed Sciences, Inc., of Oakland, Calif. A layer of water 48 is held in place by plastic casing 50 and surrounds air core secondary 46. Water has a dielectric constant which is suitable for holding a large electric field gradient in a small volume. For example, a field gradient of 420 kV/cm has been obtained with a voltage of 1 MV. Those skilled in the art will appreciate that dielectric insulators other than water can also be used. A layer of transformer oil 52 such as Dialex, made by Shell Oil Company, is contained about casing 50 by metal wall 54. Transformer 38 fits into MFCG output structure 44 (FIG. 4) which forms the primary coil of transformer 38.

Referring back to FIG. 1, conductor 40 carries the output electrical pulse from MFCG 18 into radiographic apparatus 11 through a bushing 42 connecting to a diode 58 through a conductive transfer piece 56, such as a machined aluminum baffle, which may also function as a support structure within radiographic apparatus housing 62. Diode 58, including cathode 66 and an anode 74, produces a relativistic electron beam pulse in response to receiving the approximatey 1 MV electrical pulse output of transformer 38 through conductor 40. Insulators 60 comprising Lucite or other suitable dielectric material surround diode 58 to prevent arcing and are positioned within dielectric diode housing 64. Radiographic apparatus housing 62 may contain sulphur hexafluoride to provide additional insulation.

Cathode 66 at input end 68 connects to and receives the electric pulse from diode 58 and in response thereto emits electrons represented by arrow 72 from output tip 70. In the FIG. 1 embodiment, cathode 66 can be a high quality beam emitting thermionic cathode or a field emission cold cathode, producing a higher beam current.

Electrons in beam 72 strike anode 74, spaced from cathode tip 70. Anode 74 may comprise titanium, stainless steel or the like and may comprise deuterated polyethylene to emit deuterons in response to impinging electrons from beam 72. However, anode 74 is preferably loaded with tritium and emits tritons in response to the electrons in beam 72. The tritium can be chemically bonded to anode 74 or plated thereon. Anode 74 preferably comprises an annular aperture 78 containing a foil 76 which may be made of copper. Anode 74 defines the first end of a drift chamber 80 containing an evacuated drift region 82. A neutron generating target 84 is disposed at the other end of drift chamber 80 and emits neutrons as represented by arrow 86 in response to impinging tritons or deuterons from anode 74. Neutron generating target 84 can comprise carbon or deuterated polyethylene or a tritiated material such as titanium.

The FIG. 1 embodiment is operated by closing switch 29 which causes capacitor bank 12 to generate a current for producing a magnetic field in MFCG 16, as shown in FIG. 2. Delay circuitry 17 fires detonator 19 in MFCG 16, thus initiating explosive core 24 to drive inner cylindrical conductor 22 out toward outer helical conductor 20 to compress the magnetic field therebetween and generate a first electrical pulse of about 50 kV. This first pulse is transmitted to MFCG 18, as shown in FIG. 3, to produce an intensified magnetic field within driver plates 34, 36 and fire detonator pads 36 and 34 of MFCG 18, forcing together plates 30 and 28 to compress the magnetic field therebetween and develop a relativistic output pulse on the order of about 1 MV across secondary coil 48. Transformer 38 outputs this pulse which builds up within it over a period of up to about 14 μs, there being no current carried in transformer 38 during this voltage buildup since diode 58 is configured to be initially nonconductive.

At a preselected point in the voltage buildup, diode 58 fires for between about 0.02 and 0.10 μs, serving as a plasma switch to efficiently deliver energy from transformer 38 to cathode 66. As explained below, the function of diode 58 as a plasma switch enables diode 58 to generate a relativistic electron beam from the energy pulse supplied through transformer 38.

Figure 5:
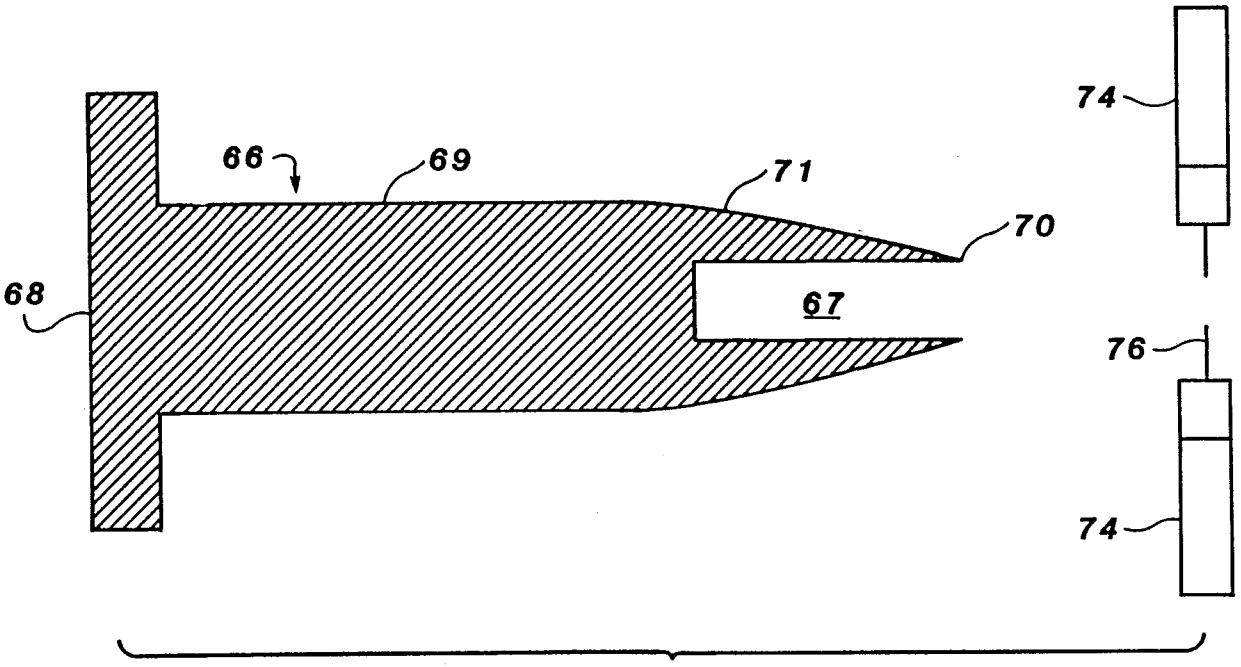
FIG. 5 is a cross-sectional view of an electron beam pulse generating cathode for use in the FIG. 1 embodiment of the invention.

FIG. 5 shows a cross-sectional view of cathode 66 and anode 74 spaced therefrom. Cathode 66 receives the diode 58 output pulse at its end 68 and emits electrons in response thereto from its output tip 70 comprising a tapered portion 71 containing a cylindrical bore 67. Cylindrical bore 67 provides a relatively large surface area for electron emission once a plasma is formed for impedance matching when energy is extracted from the output pulse of MFCGs 16, 18. This tip structure cooperates in a firing delay timing for diode 58 until voltage buildup reaches a preselected point by preventing a plasma from forming at the tip when MFCG output voltage is increasing.

In the FIG. 5 embodiment, the cylindrical portion 69 of cathode 66 is 3 cm in diameter, the tapered portion 71 slopes at 15° and is 3.73 cm long and bore 67 extends 3 cm and is 1 cm in diameter. Output tip 70 is spaced 2 cm from foil 76 of anode 74. The preferred surface finish of cathode 66 is No. 4 or better, to assist in preventing premature plasma formation. Cathode 66 and anode 74 structure and the cathode-to-anode spacing delays the production of electron beam 72 for approximately 14 μs until the voltage buildup in transformer 38 reaches at least about 1 MV. Diode 66 fires a pulse of 0.02–0.1 μs duration.

Figure 6:
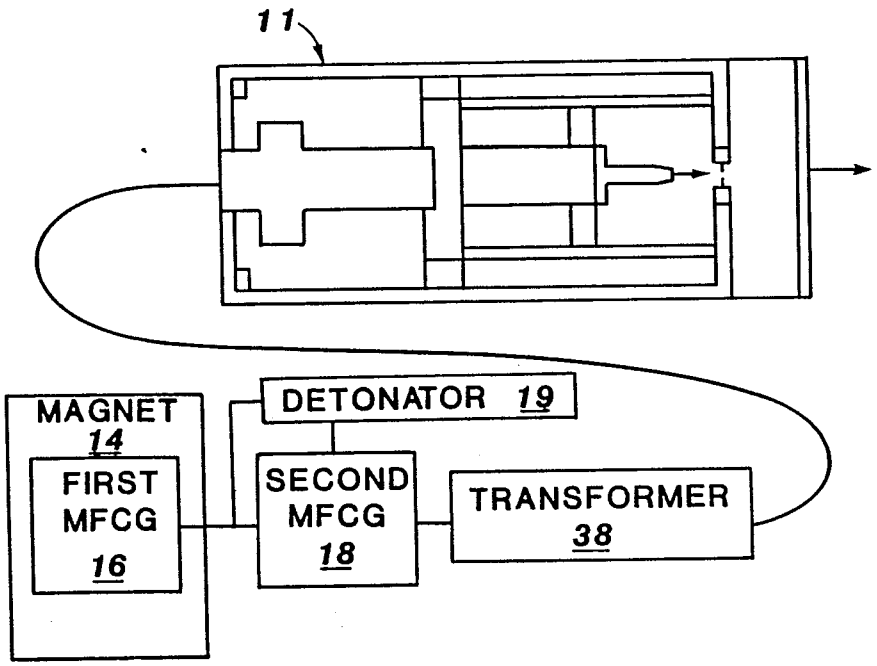
FIG. 6 schematically shows a neutron pulse generating embodiment of the invention using a permanent magnet for initial magnetic flux field generation.

FIG. 6 shows a neutron generating embodiment of the invention utilizing a permanent magnet 14 as a magnetic field generator. Transformer 38 and radiographic apparatus 11 are essentially the same as in the FIG. 1 embodiment. Permanent magnet 14 produces a magnetic field in MFCG 16.

The output pulse from first MFCG 16 produces a magnetic field in MFCG 18 and fires detonator 19 of second MFCG 18, which produces a 50 kV output pulse from MFCG 18 which is increased to 1 MV by transformer 38 for delivery to radiographic apparatus 11, as in the FIG. 1 embodiment. Neutrons are produced by radiographic apparatus 11 as discussed with reference to the FIG. 1 embodiment.

Figure 7:
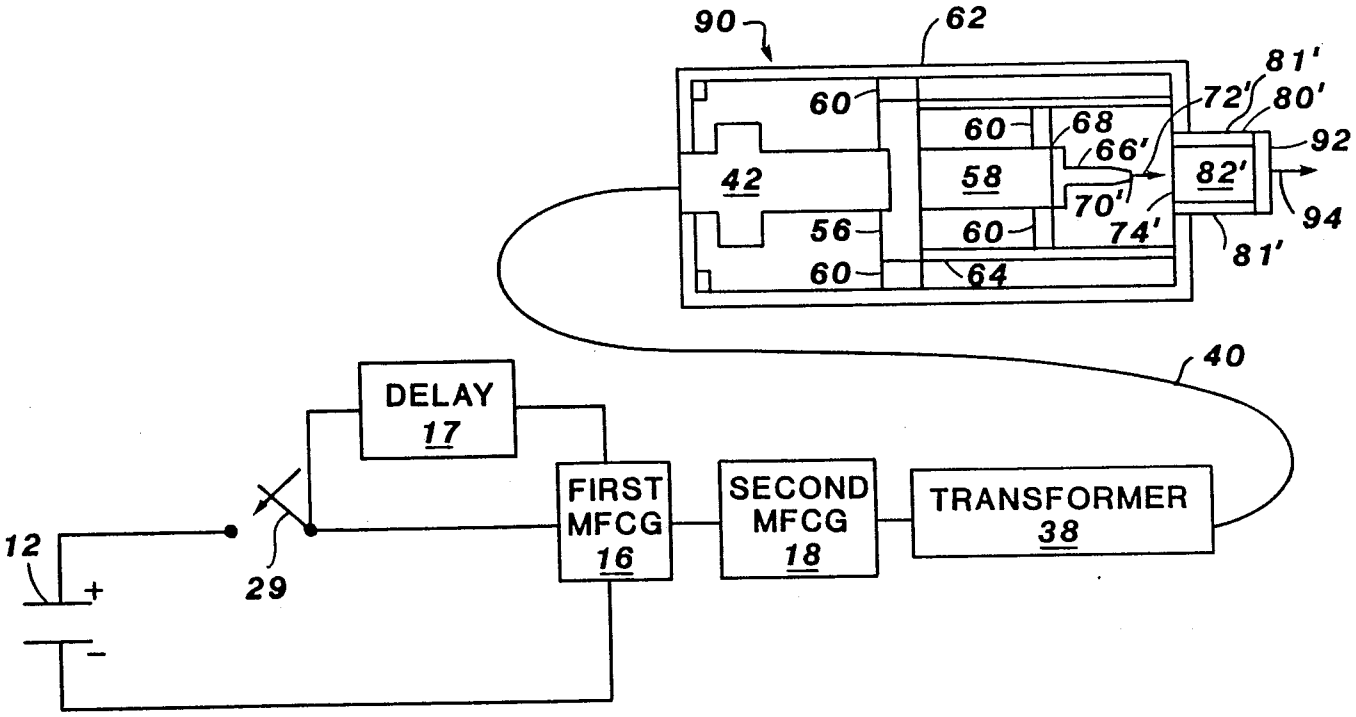
FIG. 7 schematically illustrates an x-radiography preferred embodiment of the invention using capacitative initial magnetic flux field generation.

FIG. 7 shows an embodiment of the invention for producing x-rays for use in nondestructive photon radiography. The electrical pulse producing structure, as illustrated, is essentially the same discussed with reference to FIG. 1. Capacitor bank 12, switch 29, delay circuitry 17, first and second MFCGs 16 and 18 and transformer 38 perform as previously set forth. The electrical pulse producing structure shown in FIG. 6 can also be used to produce x-rays in combination with the x-radiographic apparatus 90 of FIG. 7.

The structure of radiographic apparatus 90 is similar to apparatus 11 of FIG. 1 where indicated by identical reference numbers. However, drift chamber 80' in FIG. 7 comprises walls 81' defining a drift region 82'. Drift chamber 80' is 5 cm long and has a diameter of 7.5 cm. Thus, the boundary conditions set by the drift chamber walls 81' and the self-collapse of the electron beam 72' over its longer traverse cause the beam to focus to a diameter of from about 1 to about 2 mm by the time it reaches a Bremsstrahlung converter target 92 forming the end of drift chamber 80'. Bremsstrahlung converter target 92 possesses a high atomic number and produces an x-ray pulse represented by arrow 94 in response to the impinging electrons in beam 72'.

Figure 8:
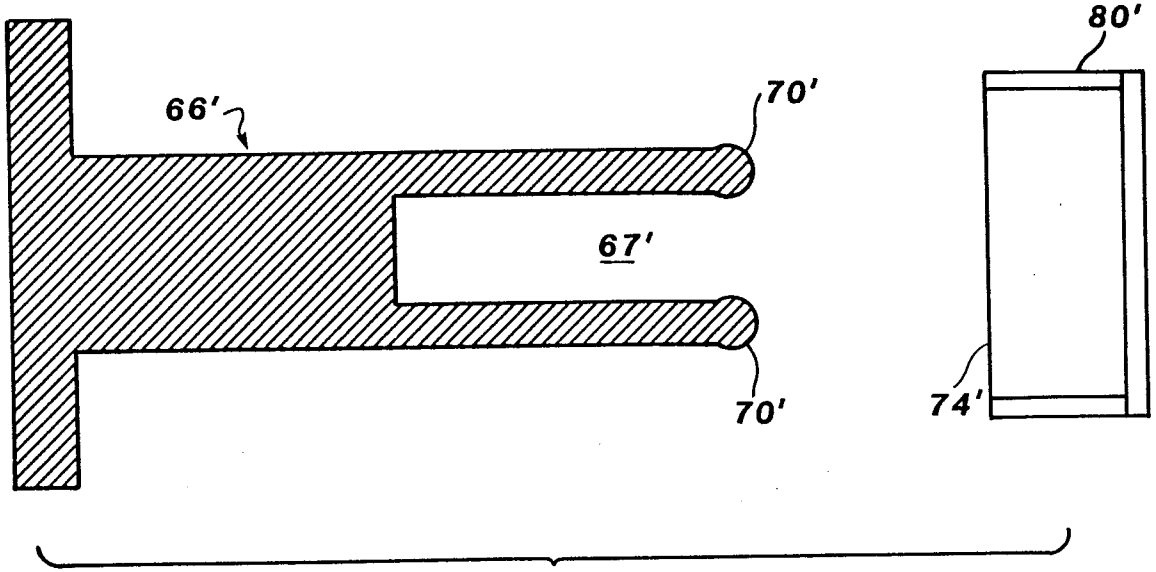
FIG. 8 is a cross-sectional view of an electron beam pulse generating cathode for use in the FIG. 7 embodiment of the invention.

FIG. 8 is a cross-sectional view of the cathode, anode and drift chamber structure of the x-radiographic apparatus 90 of FIG. 7. As seen therein, cathode 66' comprises an annular rounded tip 70' and contains a bore 67'. Annular rounded tip 70' provides a uniform electron emission during the electron pulse. Cathode tip 70' is appropriately spaced from anode 74' to cooperate in delaying the firing of diode 58 until a preselected time in the buildup of voltage in the electrical pulse from MFCG 18. Thereafter, plasma formation about tip 70 causes cathode 66 to switch to an electron emission mode for electron beam generation.

In the FIG. 7 embodiment, cathode 66' is about 6 cm in diameter, bore 67' has a diameter of approximately 4 cm and is at least about 8 cm long. Annular rounded tip 70' comprises a lip having a radius of curvature of about 1 cm. Tip 70' is spaced from anode 74' by approximately 3 cm. This structural configuration also delays the production of the 0.02 to 0.1 μs relativistic electron beam 72 for up to about 14 μs, until the electrical pulse from transformer reaches at least about 1 MV.

The foregoing description of the preferred embodiments of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A portable radiographic generator comprising:

magnet means for producing a field comprising magnetic flux;

compression generator means for compressing said magnetic flux to produce a high voltage pulse effective for generating a relativistic electron beam;

diode means having a cathode and an anode responsive to said voltage pulse for generating a relativistic electron beam pulse, said cathode and anode having a shape and spacing effective to require a high voltage therebetween from said compression generator for an initial plasma generation and to thereafter provide an increased electrode area accessible to said plasma to obtain a low resistance for high current production from said high voltage producing said plasma.

2. A generator according to claim 1, wherein said compression generator means comprises at least two explosive magnetic flux compression generators in series connection.

3. A generator according to claim 1, wherein said voltage pulse comprises a pulse up to about 14 μs in length.

4. The invention of claim 1, wherein said diode means includes said cathode with a configuration effective to generate said electron beam pulse for from about 0.02 to about 0.1 μs.

5. The invention of claim 1, wherein said high voltage pulse is on the order of 1 MV.

6. The invention of claim 2, wherein said magnetic flux compressing means comprises means for sequentially explosively comprssing magnetic flux fields in said at least two magnetic flux compression generators.

7. A generator according to claim 1, further comprising neutron generating means responsive to said electron beam pulse.

8. A generator according to claim 7, wherein said neutron generating means comprises an anode imbedded with tritium which emits tritons in response to impinging electrons from said cathode and a target for said tritons which emits neutrons in response to receiving impinging tritons from said anode.

9. A generator according to claim 7, wherein said neutron generating means comprises an anode containing deuterium which emits deuterons in response to impinging electrons from said cathode and a target for said dueterons which emits neutrons in response to receiving impinging tritons from said anode.

10. A generator according to claim 7, wherein said diode means includes a self-focusing cathode.

11. A generator according to claim 1, wherein said cathode comprises a tapered cylindrical body defining a bore therein, said cathode being spaced from said anode a distance effective to delay the production of an electron beam until said electric pulse reaches at least about 1 MV.

12. A generator according to claim 1, further comprising x-radiography generating means responsive to said electron beam pulse.

13. A generator according to claim 12, wherein said diode means comprises a Bremsstrahlung converter target means for producing x-rays.

14. A generator according to claim 13, wherein said cathode defines a bore therein with an annular rounded lip about said bore and spaced from said anode a distance effective to delay the production of an electron beam until said electric pulse reaches at least about 1 MV.

15. A generator according to claim 13, wherein said diode means comprises a self-focusing diode.

* * * * *

UNITED STATES PATENT AND TRADEMARK OFFICE

CERTIFICATE OF CORRECTION

PATENT NO. : 4,924,485

DATED : May 8, 1990

INVENTOR(S) : Robert F. Hoeberling

It is certified that error appears in the above-identified patent and that said Letters Patent is hereby corrected as shown below:

On the cover page, left hand column, between fields [76] and [21] insert -- [73] Assignee: The Untied States of America as represented by the United States Department of Energy, Washington, D.C. --.

Signed and Sealed this

Twelfth Day of November, 1991

*Attest:*

HARRY F. MANBECK, JR.

*Attesting Officer*

*Commissioner of Patents and Trademarks*